United States Patent [19]

Broderick

[11] 4,296,725

[45] Oct. 27, 1981

[54] ARCHERY BOW IMPROVEMENT AND CAMERA THEREFOR

[76] Inventor: Ronald J. Broderick, 3183 S. 8240 West, Magna, Utah 84044

[21] Appl. No.: 61,483

[22] Filed: Jul. 27, 1979

[51] Int. Cl.[3] ..... F41B 5/00

[52] U.S. Cl. ..... 124/24 R; 124/88; 354/76

[58] Field of Search ..... 124/23 R, 24 R, 41 A, 124/87, 88, 86, 80, 1; 354/75, 76, 81

[56] References Cited

U.S. PATENT DOCUMENTS 3,062,114 11/1962 Palos ..... 354/75 X 3,537,440 11/1970 Izuta ..... 124/24 R X 3,623,468 11/1971 Crest ..... 124/88 X

*Primary Examiner*—Richard C. Pinkham

*Assistant Examiner*—William R. Browne

*Attorney, Agent, or Firm*—M. Ralph Shaffer

[57] ABSTRACT

An archery bow provided with a camera that can be actuated by the archer immediately prior to arrow release. The camera is mounted to the central portion of the bow and includes a convenient mechanism for tripping the shutter of the camera immediately prior to arrow release. The shutter trip is adjustable for both right-hand and also left-hand users. A camera is provided with a housing having a conveniently operated film advance proximate the shutter trip mechanism.

3 Claims, 9 Drawing Figures

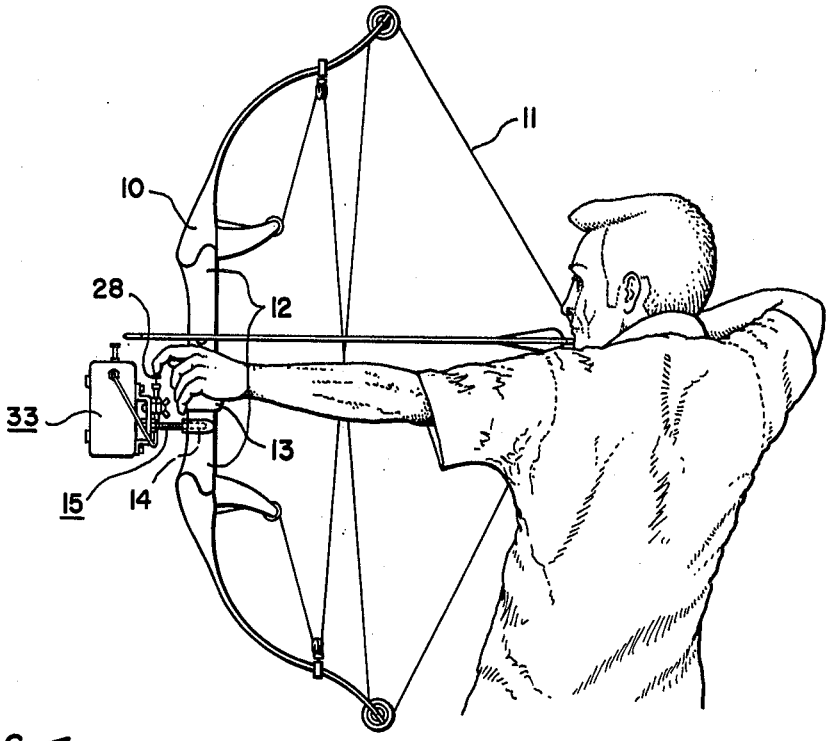
FIG. 1
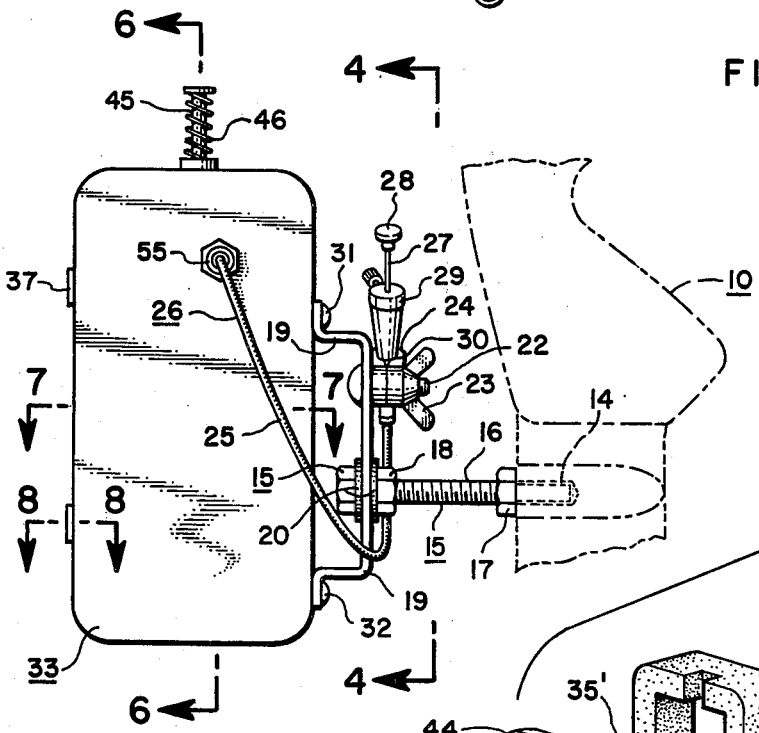
FIG. 2
FIG. 3
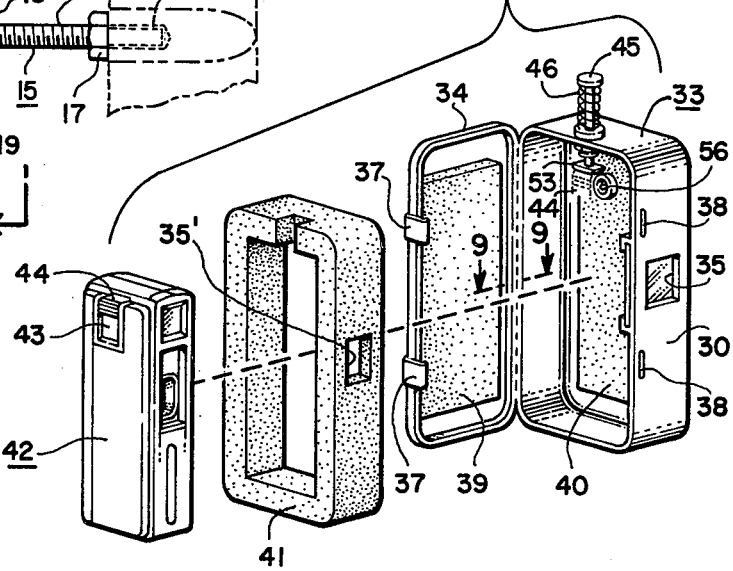

ARCHERY BOW IMPROVEMENT AND CAMERA THEREFOR

FIELD OF INVENTION

The present invention relates to archery bows and, more particularly, to archery bows wherein, as herein taught, a camera attachment is provided, and this such the camera shutter can be tripped at any convenient time and especially immediately prior to release of an arrow from full-draw position.

DESCRIPTION OF PRIOR ART

Certain United States patents have been noted in connection with bow and gun attachments in general. These U.S. Pat. Nos. are as follows: 2,282,680, 2,664,797, 3,059,370, 3,062,114, 3,179,102, 3,288,988, 3,502,062. None of the above patents teach the novel concept of mounting a camera to an archery bow. Archery bows offer particular requirements for camera mountings, among which is the requirement that the shutter control be proximate the grip of the bow so that the user can simply depress by his forefinger, for example, the shutter mechanism and actuate the camera immediately prior to arrow release; at all costs the time between tripping the camera and shooting the arrow should be minimized, this so as to insure that the game being aimed at is photographed immediately prior to felling the animal.

BRIEF DESCRIPTION OF THE INVENTION

According to the present invention a camera is provided with an archery bow, the camera being mounted to the archery bow such that the user, with his grip hand, can actuate the camera immediately prior to arrow release. This can be easily accomplished even though the bow string is at full-draw position. In a preferred form of the invention the shutter tripping mechanism takes the form of a cable attachment that can be easily adjusted for right hand and left hand users. Likewise, a film advance is disposed proximate the grip hand of the user so that the film can be easily advanced once the picture is taken, the arrow released, and preparatory to the positionment of the new arrow. In a preferred form of the invention suitable bracket means is provided for mounting the camera to the bow in essentially the same plane as the bow, this so as to not interfere with arrow positionment or release. The camera itself is preferably enclosed in a padded case, suitably equipped, so that jarring and impact will not damage the camera.

OBJECTS

Accordingly, a principle object of the present invention is to provide a camera attachment for archery bows.

A further object is to provide an improved archery bow having a camera attachment.

A further object is to provide a camera attachment that can be easily adjusted for both right hand and left hand users.

A further object is to provide a camera attachment for archery bows wherein shutter control and film advance can be easily manipulated by the grip hand of the user.

BRIEF DESCRIPTION OF DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

FIG. 1 is a side elevation of an archer employing an archery bow of the present invention provided with a camera attachment.

FIG. 2 is an enlarged detail of the camera attachment at FIG. 1, showing its mounting to the central portion of the bow as seen in phantom lines.

FIG. 3 is an exploded perspective view of the camera and case structure employed herein in a preferred embodiment of the invention.

DESCRIPTION OF PREFERRED EMBODIMENTS

Figure 4:
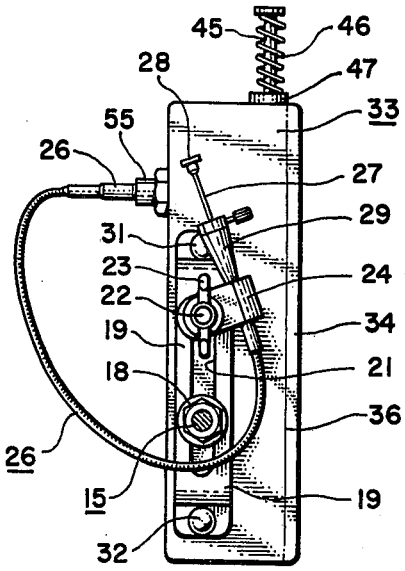
FIG. 4 is a rear elevation of the camera attachment and is taken along the lines 4—4 in FIG. 2.

In FIG. 1 the bow 10 is shown to include a usual pulley arrangement provided bow string 11. A central portion 12 of bow 10 is provided with a grip 13. Disposed proximate central portion 12, and preferably underneath the grip 13 is an internally threaded metal insert 14, by way of example, and which is generally supplied bows. The insert 14 herein is used to provide a secure mounting for bolt 15, the same being provided threaded shank 16 which threads into insert 14. Locknuts at 17 and 18 are provided, with the bolt 15 thereby being firmly secured to slotted bracket 19. The bracket is slideable up and down, when locknut 18 is loosened, by the provision of bearing washers 20. Accordingly, the disposition of the camera may be varied up and down in accordance with particular bow design and user requirements. The slot is shown at 21 in FIG. 4 which accommodates such slideable adjustment.

Also mounted to camera bracket 19, this time via bolt 22 and wingnut 23, is a U-shaped resilient mounting bracket 24 that is employed to mount in appropriate disposition the elongate flex sleeve 25 of shutter trip control cable 26. The cable itself may be conventional, having inner trip wire 27 provided actuation button 28. A receiving boss 29 receives the wire and is pinched or retained in place by virtue of the central opening 30 of U-shaped mounting bracket 24.

Bracket 19 is securely mounted by rivets 31 and 32, or other suitable attachments, to camera case 33. Case 33 is shown in some detail in FIG. 3, and includes lid 34. The case itself is provided with lens aperture 35 and suitable live hinges and latches as at 36 and 37, by way of example. Latches 37, where employed, will co-act with camera case protuberances 38 in a conventional manner.

Rubber, stryrofoam, or other suitable padding is disposed at 39 and 40, with a semi-padded enclosure 41 also being provided so as to protect the camera against jarring as well as deadening shutter noise. While many types of cameras may be employed, the inventor has selected by way of example the Kodak Instamatic 20 camera as at 42. As is common with this and other types of cameras, there is a vertically actuatable spring-loaded film advance slide 43 provided with button 44. This film advance is actuated in the present invention by the camera case 33 herein being provided a thumb or finger actuated button 45 that is spring-biased by compression spring 46.

Figure 6:
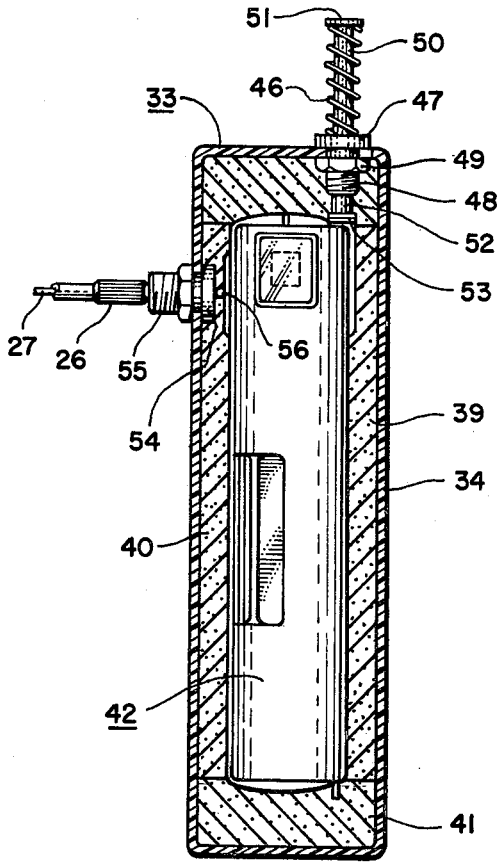
FIG. 6 is an enlarged vertical section taken along the line 6—6 in FIG. 2.
Figure 7:
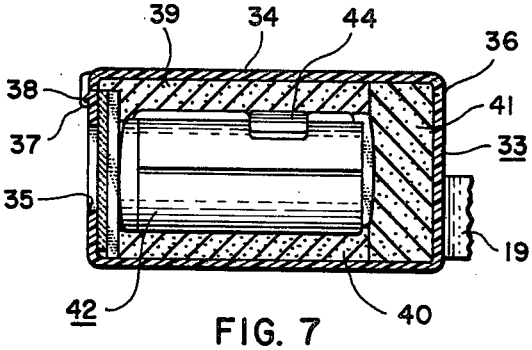
FIG. 7 is a horizontal transverse section taken alone the line 7—7 in FIG. 2.
Figure 8:
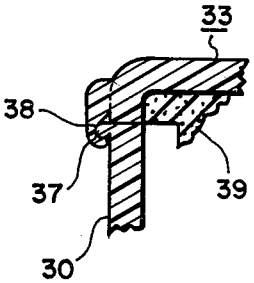
FIG. 8 is an enlarged fragmentary detail, shown in section, of representative latch structure of the camera case.
Figure 9:
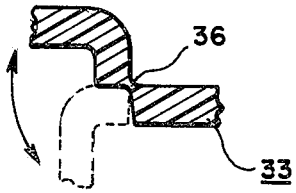
FIG. 9 is an enlarged fragmentary detail, principally in section, of a representative live hinge that can be employed in the camera cage structure where the same is molded of suitable plastic such as a medium density polyurethane.

In referring to FIG. 6 it is seen that an eyelet mount 47 is supplied, is threaded at 48, and receives locknut 49. The film advance rod 50 is circumscribed by spring 46, includes top 51, and also a base portion 52 provided with foot 53. It is the foot 53 that actuates button 44 for advancing the film. The camera includes a conventional shutter trip mount at 54 to which the shutter trip cable 26 is attached. For purposes of convenience, the case 33 may include a threaded vase attachment at 55 so that the inner shutter trip wire can be connected to the shutter trip mechanism 56 of the camera in a conventional manner.

Figure 5:
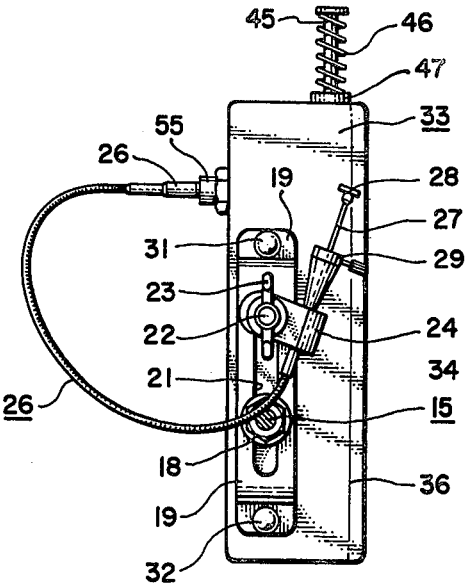
FIG. 5 is similar to FIG. 4 but illustrates the shutter trip mechanism of the camera as being adjusted for a left-handed archer.

FIGS. 4 and 5 illustrate that the wing nut 23 can be loosened so that the bracket 24 can be pivotally displaced to accommodate, as per FIG. 4 and FIG. 5, respectively, right-hand and also left-hand archers. Accordingly, the wing nut 23 is simply re-tightened in accordance with the desires of the user.

Of course, any resilient enclosure such as the case 41 in FIG. 3 will include an aperture 35' provided for lens viewing and exposure.

In operation of the bow, it is noted that the archer, even at full draw position, see FIG. 1, can simply conveniently depress the shutter trip via button 28 immediately prior to releasing the arrow. Accordingly, a picture is taken of the game being fired at immediately prior to the time the arrow takes flight.

If the shot is missed, at least the archer will have a picture of the game sited. Furthermore, where the arrow strikes home, the archer will have a picture of the game immediately taken prior to the felling of the game.

It is noted that the camera will be disposed preferably in the same plane as the bow, and forwardly thereof, and will be dimensioned so as not to interfere with arrow flight. The finger control for the camera structure is immediately available to the archer, whether he is left-handed or right-handed, see FIGS. 4 and 5, whereby a picture can be immediately taken even at full draw condition of the bow.

While particular embodiments of the present invention have been shown and described, it will be obvious to those skilled in the art that changes and modifications may be made without departing from this invention in its broader aspects, and, therefore, the aim in the appended claims is to cover all such changes and modifications as fall within the true spirit and scope of this invention.

I claim:

1. In combination, an archery bow, and forwardly-facing camera means attached to said archery bow, said camera means comprising a camera, a padded case encasing said camera and having aperture means accommodating exposure-functioning of said camera, said case being provided with spring-biased means for effecting selective camera film-advance, said case also being provided with shutter-trip control means adjustably secured relative to said archery bow.

2. In combination, an archery bow, and forwardly-facing camera means attached to said archery bow, said camera means comprising a padded openable case, a camera operatively retained in said case, a shutter-trip mechanism coupled through said case to said camera, first means for securing said case to said archery bow, and second means adjustably secured to said first means for adjustably securing said cable mechanism for both right-hand and left-hand archers.

3. In combination, an archery bow, and forwardly-facing camera means attached to said archery bow, said camera means including a vertically slotted bracket, elongate means adjustably securing said camera means at said slotted bracket to said archery bow, an elongate cable-type shutter-trip mechanism, and rotationally displaceable means for adjustably mounting said shutter-trip mechanism to said bracket for finger-actuation by both right-handed and left-handed archers.

* * * * *